US006840765B2

(12) United States Patent
Sakai

(10) Patent No.: US 6,840,765 B2
(45) Date of Patent: Jan. 11, 2005

(54) MULTI-LAYERED HEAT TREATMENT FURNACE, HEAT TREATMENT UNIT, AND METHOD OF HEAT TREATMENT

(75) Inventor: Takayuki Sakai, Ogasa-gun (JP)

(73) Assignee: Asahi Tec Corporation (JP)

( * ) Notice: Subject to any disclaimer, the term of this patent is extended or adjusted under 35 U.S.C. 154(b) by 0 days.

(21) Appl. No.: 10/451,536

(22) PCT Filed: Dec. 18, 2001

(86) PCT No.: PCT/JP01/11106

§ 371 (c)(1),
(2), (4) Date: Jun. 24, 2003

(87) PCT Pub. No.: WO02/053787

PCT Pub. Date: Jul. 11, 2002

(65) Prior Publication Data

US 2004/0048218 A1 Mar. 11, 2004

(30) Foreign Application Priority Data

Dec. 27, 2000 (JP) ..... 2000-397093

(51) Int. Cl.[7] ..... C21D 9/34
(52) U.S. Cl. ..... 432/184; 432/183; 432/28
(58) Field of Search ..... 432/23, 28, 184, 432/197, 215, 183, 214; 266/172, 258; 34/202

(56) References Cited

U.S. PATENT DOCUMENTS 392,223 A * 11/1888 Parmelee et al. ..... 432/184
2,835,483 A * 5/1958 Lindsay ..... 122/233
4,054,376 A * 10/1977 Wareham ..... 351/178
4,220,445 A * 9/1980 James et al. ..... 432/250
4,249,889 A * 2/1981 Kemp ..... 432/11
4,599,067 A * 7/1986 Schwing et al. ..... 432/58

FOREIGN PATENT DOCUMENTS

| | | |
|---|---|---|
| JP | 64-2645 | 1/1989 |
| JP | 3-105193 | 5/1991 |
| JP | 4-116112 | 4/1992 |
| JP | 2001-316747 | 11/2001 |

* cited by examiner

*Primary Examiner*—Gregory Wilson
(74) *Attorney, Agent, or Firm*—Parkhurst & Wendel, L.L.P.

(57) ABSTRACT

There is provided a heat treatment unit which uses a multi-layered heat treatment furnace (1) comprising a layer of fluidized bed (2) composed of particles and another layer of atmosphere layer (3) composed of gases, the former being excellent in thermal efficiency and uniformity of heat distribution and the latter being positioned in the free board section over the fluidized bed (2), in which these layers operate at temperature levels different from each other, and the work piece is heat-treated by being partly immersed in the fluidized bed (2) having a given temperature with the other part being exposed in the atmosphere layer (3) also operating at a given temperature, according to desired mechanical properties of the work piece at each position. This heat treatment unit is improved from the conventional one in that it can give desired mechanical properties which are required by each part of metallic work requires without increasing the investment cost.

13 Claims, 7 Drawing Sheets

MULTI-LAYERED HEAT TREATMENT FURNACE, HEAT TREATMENT UNIT, AND METHOD OF HEAT TREATMENT

TECHNICAL FIELD

The present invention relates to a heat treatment furnace to be used for heat-treating metals, a heat treatment unit and a method of heat treatment. More particularly, the present invention relates to a multi-layered heat treatment furnace comprising a fluidized bed and an atmosphere layer for heat treatment of metallic products, e.g., automobile members of aluminum alloy around wheels to improve their mechanical strength, a heat treatment unit incorporating the heat treatment furnace, and a method of heat treatment using the heat treatment unit.

BACKGROUND ART

A metal is known to show the phenomenon known as transformation (in a broad sense) in which its properties change with temperature, even in the same solid state, and has conventionally been thermally treated by the method involving heating/cooling cycles for the purpose of improvement of its strength, or the like. In case of an alloy composed of two or more types of metals, in particular, each component has its own solubility changing with temperature. Therefore, it is possible to greatly change its properties by changing the quantity of one metal dissolved in another metal by a heat treatment.

For example, an aluminum alloy (hereinafter sometimes referred to as Al alloy), which is relatively low in cost and can be easily utilized among light alloys, has been extensively used for the areas where a reduction in material weight is required (e.g., aircraft and automobiles). An aluminum alloy can have changed mechanical characteristics, e.g., tensile strength and elongation, when subjected to heating and cooling. This is because an aluminum alloy is composed of aluminum incorporated with copper, magnesium, silicon, zinc or the like, and the changes in characteristics are realized by dissolving these elements in the matrix by heat treatment, which is followed by cooling the alloy with water and age-hardening.

More specifically, one of the aluminum alloys for cast and expanded materials is an Al—Cu-based alloy which contains copper, shows a higher strength, and has been extensively used for automobile members around wheels; and in this Al—Cu-based alloy, it is possible to change its mechanical properties by changing the quantity of copper dissolved in aluminum.

An Al—Cu-based alloy is known to dissolve copper to a limited extent at room temperature, and is in the $\alpha$-phase region at a high temperature. When an Al—Cu-based alloy is heated at a high temperature, therefore, it has the $\alpha$-phase with copper dissolved in aluminum. The heat-treated alloy will have significantly different properties depending on whether it is rapidly quenched with water or slowly cooled, because of the $\theta$-phase, with deposited aluminum and copper compounds which determine alloy hardness, appearing differently. When quenched, the alloy will have no $\theta$-phase depositing out, but become the supersaturated solid solution which dissolves the same quantity of copper as it is at a high temperature. This treatment is known as solution treatment.

The supersaturated solid solution is unstable, turning stable when exposed to a higher temperature or left at room temperature for extended periods, after the $\theta$-phase emerges. This phenomenon is known as the age-hardening, and the treatment for causing the age-hardening is referred to as the age-hardening treatment. Normally, an artificial age-hardening treatment is conducted to cause the age-hardening treatment by increasing temperature. (The artificial age-hardening treatment is hereinafter referred to merely as age-hardening treatment.) The artificial age-hardening treatment is adopted in order to reduce the treatment time. At the same time, it can generally give better properties, e.g., tensile strength, with the age-hardening treatment at a certain high temperature than the natural age-hardening treatment in which the work is left at room temperature for extended periods.

The solution/age-hardening treatment is an effective heat treatment method for improving mechanical strength of a metallic product.

However, some metallic products are required to have an area having different mechanical properties from the other area, e.g., one part is required to be hardened or to be more ductile than the other. To meet such requirements needs a more complex heat treatment process, accompanied by increased cost. Therefore, such a metallic product is normally heat-treated at temperature set at a level not harmful to any required mechanical property at any place.

For example, an aluminum wheel 20 shown in FIG. 2, an outer rim 21 and a spoke 22 need to have a high strength, whereas an inner rim 23 needs to have a high ductility in addition to high strength. Since it is difficult to partly change heat treatment conditions in the heat treatment with the conventional atmosphere furnace, the whole aluminum wheel 20 is frequently heat-treated under the conditions normally set to improve strength as the major objective with keeping ductility above a certain level.

Therefore, there have been great demands for the heat treatment unit and method which can change heat treatment conditions depending on areas of a metallic product and thereby impart different mechanical properties to each area.

The present invention has been made in view of the above conventional problems. It is an object of the present invention to provide a heat treatment furnace which is improved over the conventional one in that it can give preferable mechanical properties which a specific area of metallic work requires without increasing an investment cost, a heat treatment unit incorporating the same furnace, and a method of heat treatment using the same heat treatment unit. A metallic product having more desired properties can be made thinner to reduce the production cost. In particular for a product of aluminum alloy, which is frequently used to reduce weight, the thinner product is lighter and should contribute to its increased demands.

DISCLOSURE OF THE INVENTION

The applicants of the present invention have found, after having extensively studied the method and unit for heat treating metals to solve the above problems, that the above objects can be achieved by heat-treating a work piece in a heat treatment furnace of a layered structure constituting a heat treatment unit and comprising a layer of fluidized bed composed of particles and another layer of atmosphere layer composed of gases, the former being excellent in thermal efficiency and uniformity of heat distribution and the latter being positioned in a free board section over the fluidized bed, in which these layers operate at temperature levels different from each other, and the work piece to be heat-treated is partly immersed in the fluidized bed operating at a given temperature and partly exposed to a heat medium in the atmosphere layer also operating at a given temperature, in order to secure desired mechanical properties of the work piece.

That is, according to the present invention, there is provided a multi-layered heat treatment furnace for heat treatment of a metallic work piece to improve its properties, comprising a fluidized bed with particles fluidized in a container by hot wind blown into the container, and an atmosphere layer over the fluidized bed with air as a heat medium, characterized in that the work piece is heat-treated by being partly immersed in the fluidized bed and partly exposed to the heat medium in the atmosphere layer.

In the aforementioned multi-layered heat treatment furnace, it is preferable that means for transferring the work piece is provided within the furnace to transfer the work piece to be heat-treated therein, and that a ratio of the part of the work piece immersed in the fluidized bed to the other part exposed to the heat medium in the atmosphere layer is variable in the range from 0/100% to 100/0%. It is possible to thermally treat two or more work pieces simultaneously in one multi-layered heat treatment furnace.

In the multi-layered heat treatment furnace of the present invention, it is preferable that the hot wind tube which blows air comprises of a header tube and a dispersion tube, and that at least dispersion tube is disposed in the fluidized bed. It is also preferable that the multi-layered heat treatment furnace is equipped with a mechanism for reducing temperature of the atmosphere layer, and also with a mechanism for automatically controlling the fluidized bed interface or automatically controlling temperature.

The multi-layered heat treatment furnace of the present invention can suitably heat treat automobile members of aluminum alloy around wheels.

According to the present invention, there is further provided a heat treatment unit which incorporates the multi-layered heat treatment furnace as an aging treatment furnace, equipped with a heat-resistant dust collector and a heat exchanger, in addition to the solution and aging treatment furnaces, characterized in that an exhaust gas from the solution treatment furnace is passed through the dust collector to remove dust and then through the heat exchanger to recover waste heat from the exhaust gas, the recovered heat being reused as a heat source for the aging treatment furnace.

The present invention also provides a method of heat treatment of a metallic work piece, to improve its properties first by solution treatment and then by aging treatment, using the multi-layered heat treatment furnace comprising a fluidized bed with particles fluidized in a container by hot wind blown into the container, and an atmosphere layer over the fluidized bed with air as a heat medium, in which the work piece is heat-treated with a part of the work piece being immersed in the fluidized bed and the other part being exposed to the heat medium in the atmosphere layer to give different heat-treatment effects. It can be used at least for aging treatment, in which the age-hardening can be controlled for the work piece depending on parts.

It is preferable in the aging treatment using the aforementioned heat treatment method to control fluidized bed temperature to the aging temperature. It is also preferable to control fluidized bed temperature in such a way that the atmosphere layer has the target aging temperature. The aging temperature is preferably around 150 to 210° C., when the work piece is of an aluminum alloy.

BEST MODE FOR CARRYING OUT THE INVENTION

The present invention will be described in detail below by the embodiment of the invention. However, it is needless to say that the present invention is by no means limited by the following embodiment.

The multi-layered heat treatment furnace of the present invention is used for heat treatment of a work piece of metal to improve its properties. The solution and aging treatments for improving mechanical properties of, e.g., an Al alloy, are generally carried out in an atmosphere furnace, e.g., tunnel furnace, with air as the heat medium. This type of furnace, however, involves several disadvantages, e.g., low heating rate and wide fluctuations of temperature of around ±5° C., which hinder solution treatment at a higher temperature. Moreover, an atmosphere furnace, e.g., a conventional tunnel furnace, needs a large-size heat treatment unit, which tends to push up the investment cost. More recently, therefore, a heat treatment furnace incorporating a fluidized bed has been used for solution and aging treatments of an Al alloy.

The present invention relates to a heat treatment furnace of multi-layered structure, comprising a fluidized bed and atmosphere layer over the fluidized bed, a heat treatment unit which incorporates the multi-layered heat treatment furnace as the aging treatment furnace, and a method of heat treatment which uses the heat treatment unit.

In the present invention, the multi-layered heat treatment furnace comprises a fluidized bed with particles fluidized in a container by hot wind blown into the container, and an atmosphere layer over the fluidized bed with air as the heat medium, and characterized in that a work piece is heat-treated by being partly immersed in the fluidized bed with the other part being exposed to the heat medium in the atmosphere layer. The fluidized bed is composed of particles, e.g., those of silicon oxide, whereas the atmosphere layer is composed of gases represented by air, and therefore, it is possible to operate the fluidized bed and the atmosphere layer at different temperatures, caused by thermal conductivity of the gaseous phase, when only the fluidized bed is heated. At this time, if the work piece is heat-treated at different temperatures depending on parts by bringing one part in contact with one layer and the other part with the other layer, it becomes possible to impart mechanical properties varying depending on parts.

The multi-layered heat treatment furnace of the present invention will be described in more detail hereinbelow by referring to the attached drawings.

Figure 1:
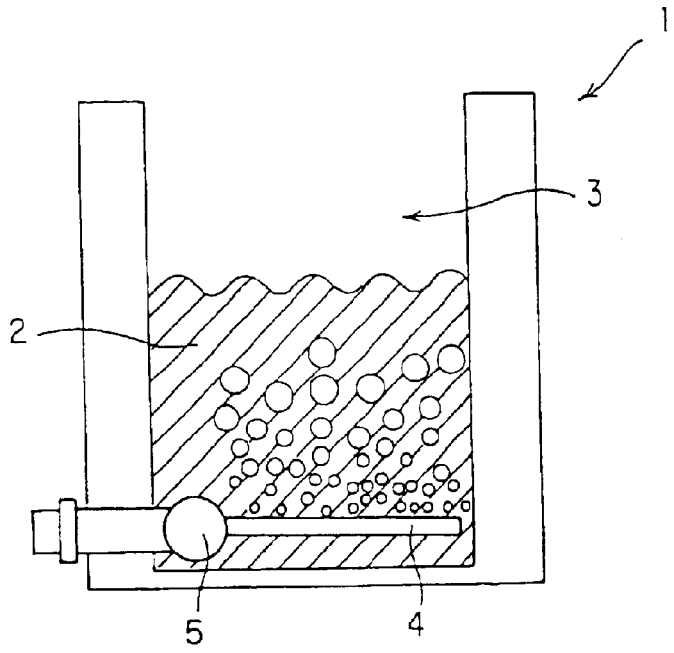
FIG. 1 is a cross-sectional view showing one embodiment of the multi-layered heat treatment furnace of the present invention.

FIG. 1 is a cross-sectional view showing one embodiment of the multi-layered heat treatment furnace of the present invention. The multi-layered heat treatment furnace 1 of the present invention preferably adopts the heating method in which hot wind is directly blown into a fluidized bed 2 via the hot wind tube having a header tube 5 and a dispersion tube 4. This method heats the fluidized bed 2 inside almost uniformly and at high heat transfer efficiency, because the particles in the container are heated, fluidized and mixed with each other uniformly by the hot wind blown into the container. The fluidized layer 2 obtains nearly uniform temperature and is excellent in heat transfer efficiency. At this time, the container which contains the fluidized bed 2 is preferably made of a highly insulating material, to prevent wasteful loss of heat.

The fluidized bed 2 is heated by hot wind blown into the fluidized bed 2 containing the particles via the header 5 and dispersion tube 4, where the hot wind is heated to a given temperature, e.g., 700 to 800° C., by a heat generator (not shown) which heats air sent from a blower by, e.g., burners. The fluidized bed 2 is equipped with the hot wind tube inside, which comprises the pressure-regulating header 5 and two or more dispersion tubes 4 branches off from the header 5. Each dispersion tube 4 is provided with a number of ports open, e.g., downwards, from which air is blown into the fluidized bed 2 to fluidize and heat the particles. The fluidized bed 2 inside is heated at, e.g., 540 to 550° C. in the case of solution treatment of an Al alloy, to quickly heat the work piece.

The present invention uses the gas layer, formed over the fluidized bed 2, as the atmosphere layer 3. Hot wind may be directly blown into the atmosphere layer 3 to heat it independently from the fluidized bed 2. However, the atmosphere layer 3 can be invariably heated, when the side of the fluidized bed 2, contained in a highly insulated container as described above, is opened to the atmosphere layer 3 or separated from the atmosphere layer 3 via a low-insulating wall to release the heat to the side of the atmosphere layer 3. It is preferable to indirectly heat the atmosphere layer 3 with the heat transferred from the fluidized bed 2, viewed from heat source utilization efficiency.

In the multi-layered heat treatment furnace 1 which incorporates the indirectly heated atmosphere layer 3 with the upper wall partly exposed to the atmosphere, there is a certain temperature difference between the atmosphere layer 3 and fluidized bed 2 directly heated by hot wind, determined by type of gases which constitute the atmosphere layer 3. For example, when the atmosphere layer 3 in the multi-layered heat treatment furnace 1 is composed of air, and fluidized bed 2 is operated at 190° C. as aging treatment temperature, temperature in the atmosphere layer 3 is around 130° C., stabilized at a temperature around 60° C. lower. Since the heat treatment effect can be sufficiently changed at a differential temperature of around 60° C., it is preferable to use air as the least expensive gas constituting the atmosphere layer 3.

It is also preferable to change the differential temperature, as required, by closing the multi-layered heat treatment furnace 1 and changing the gas type, and also to provide means for decreasing atmosphere layer temperature. This means involves, e.g., blowing colder air into the layer, or opening or closing the upper side of the multi-layered heat treatment furnace 1 for a given time or to a given area. When this is coupled with changing the gas type for the atmosphere layer 3, a varying differential temperature, in addition to that determined by the gas type, can be secured.

It is possible to thermally treat a work piece at different temperatures depending on parts, e.g., for aging treatment and thereby to impart desired properties to the work piece different depending on parts, when the work piece is treated in the multi-layered heat treatment furnace 1 comprising the fluidized bed 2 and atmosphere layer 3 operating at a certain differential temperature between them as mentioned above in such a way that a part of the work piece is immersed in the fluidized bed 2 and the other part is exposed to the heat medium in the atmosphere layer 3. The part of the work piece treated in the fluidized bed is age-hardened to a higher extent for the same treatment time, because it is heated at a higher rate to a higher temperature than the other part, to have the highest tensile strength. The part treated in the atmosphere layer, on the other hand, being heated at a lower rate to a lower temperature, is age-hardened to a lower extent even for the same period of heating time, to have a higher elongation, because it is in the sub-aged condition.

Figure 2:
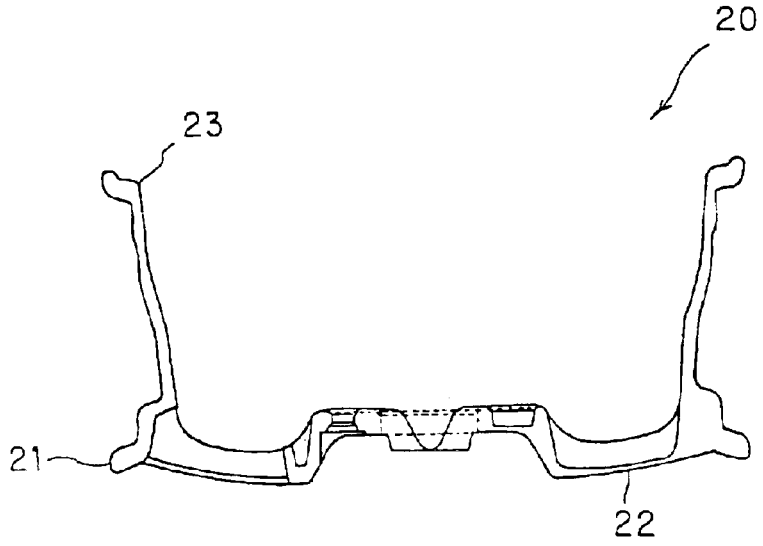
FIG. 2 is a cross-sectional view of an aluminum wheel as one example of the work piece to be thermally treated.
Figure 3:
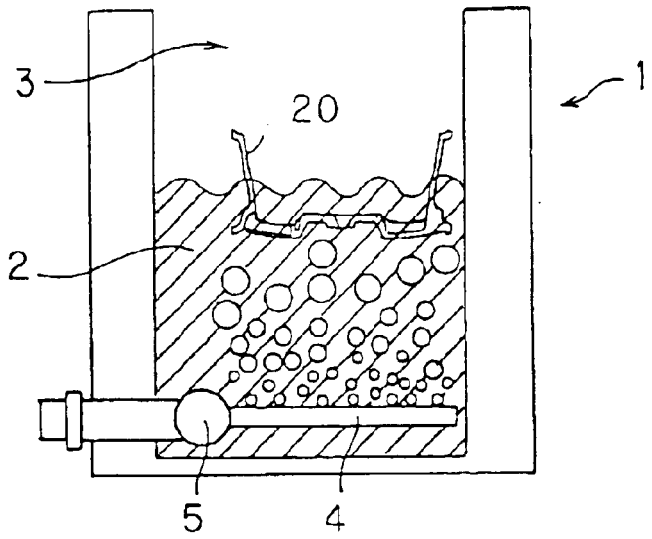
FIG. 3 is an explanatory view showing one embodiment of the heat treatment unit which incorporates the multi-layered heat treatment furnace of the present invention.
Figure 4:
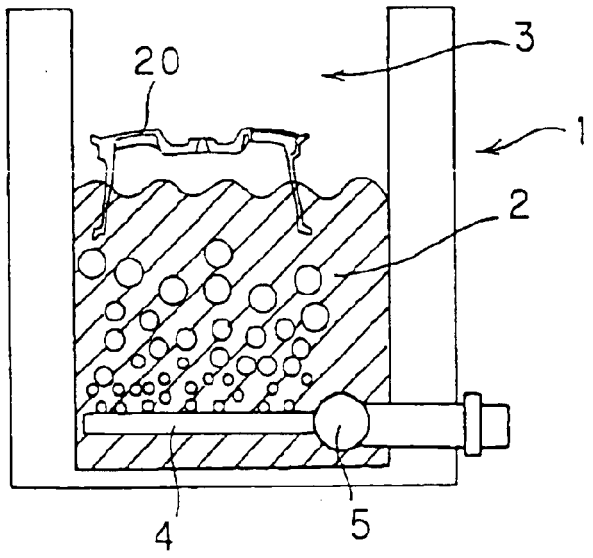
FIG. 4 is an explanatory view of another embodiment of the heat treatment unit which incorporates the multi-layered heat treatment furnace of the present invention.

As mentioned above, it is important for the aluminum wheel 20 shown in FIG. 2 for the outer rim 21 and the spoke 22 to have a high strength, whereas it is important for the inner rim 23 to have a high ductility in addition to high strength. It is therefore possible to impart the mechanical properties each area requires by immersing the outer rim and the spoke in the fluidized bed 2 and exposing the inner rim in the atmosphere layer 3 as shown in FIG. 3, or by immersing the inner rim in the fluidized bed 2 and exposing the outer rim and the spoke to the heat medium in the atmosphere layer 3 as shown in FIG. 4. When treatment temperature and time in the fluidized bed 2 are adjusted to age the work piece to the highest extent in the method shown in FIG. 3, the inner rim will be in the sub-aged condition. On the other hand, when treatment temperature and time in the fluidized bed 2 are adjusted to treat the work piece to the super-aged condition in the method shown in FIG. 4, the inner rim will be in the super-aged condition to expectedly have a high ductility, whereas the outer rim and the spoke treated in the atmosphere layer 3 are aged to almost the highest extent.

Moreover, the multi-layered heat treatment furnace 1 is preferably equipped with means for transferring the work piece within the furnace, in order to control the heat treatment conditions more finely, because a ratio of the part of the work piece immersed in the fluidized bed 2 to the other part exposed in the atmosphere layer 3 is variable in the range from 0/100% to 100/0%. For example, a lift on which the work piece is placed to be moved in the vertical direction, when provided in the furnace as the means for transferring the work piece, allows one part of the work piece to be thermally treated for a given time in the fluidized bed 2 operating at a higher temperature while the other part to be treated also for a given time in the atmosphere layer 3 operating at a lower temperature. This type of operation has advantages, e.g., more finely adjusted age-hardening with regard to tensile strength and elongation.

Furthermore, in a heat treatment using the multi-layered heat treatment furnace 1 of the present invention, since the multi-layered heat treatment furnace 1 comprises the fluidized bed 2 and atmosphere layer 3 operating at different temperatures, it is possible to thermally treat a plurality of work pieces simultaneously by the single furnace. For example, two or more work pieces having different solution treatment temperatures can be treated by the fluidized bed 2 and atmosphere layer 3 each adjusted at temperature suitable for each work piece in such a way that one work piece is immersed in the fluidized bed 2 while the other is exposed in the atmosphere layer 3 for the solution treatment. The simultaneous heat treatment can increase the throughput, thereby reducing the metallic product production cost.

In the present invention, the multi-layered heat treatment furnace of the present invention is preferably equipped with a means for automatically controlling the fluidized bed interface. The means for automatically controlling the fluidized bed interface automatically adjusts the interface with the fluidized bed 2 at a desired level, as required or when the interface unintentionally fluctuates. The means for automatically controlling the fluidized bed interface is preferably combined with an instrument for measuring the fluidized bed interface (not shown) at one corner of the multi-layered heat treatment furnace 1, when the furnace is in the shape of almost rectangular parallelepiped and has an almost square horizontal cross section, and also with a mechanism of supplying the particles, based on the measured interface level, by a particle-supplying unit (not shown) provided on the furnace. More specifically, the instrument for measuring the fluidized bed interface measures the interface of the particles constituting the fluidized bed by, e.g., a photoelectric tube through transparent heat-resistant glass.

When the multi-layered heat treatment furnace 1 is equipped with the means for automatically controlling the fluidized bed interface, the single multi-layered heat treatment furnace 1 can easily handle work pieces of varying size, because volume of each of the fluidized bed 2 and atmosphere layer 3 can be optionally changed, as required. The heat treatment conditions can be easily adjusted for each part of the work piece by the multi-layered heat treatment furnace 1 by itself, still more efficiently when it is equipped with means for transferring the work piece within the furnace. Moreover, the means for automatically controlling the fluidized bed interface prevents abnormal interface fluctuations, thereby preventing the problems resulting from the insufficient heat treatment, e.g., deteriorated quality of the metallic product and decreased product yield.

In the present invention, the multi-layered heat treatment furnace is also preferably equipped with a means for automatically controlling temperature in the fluidized bed. One example of the means for automatically controlling temperature in the fluidized bed is a mechanism of controlling temperature of the hot wind blown into the fluidized bed 2 through a gas flow control valve or the like provided in the tube leading to the hot wind tube, based on temperature level measured by thermometers (not shown), which are provided at each corner of the furnace 1 when it is in the shape of almost rectangular parallelepiped and has an almost square horizontal cross section. If such a means for automatically controlling temperature in the fluidized bed is provided, manpower can be saved, and abnormal temperature fluctuations are hardly caused, thereby preventing problems, e.g., failing to achieve the expected effect by the heat treatment.

Using the means for automatically controlling temperature in the fluidized bed makes easier the control of setting temperature in the fluidized bed 2 at the level suitable, e.g., for the aging treatment. When temperature in the fluidized bed 2 is set at 170° C. for the aging treatment, the atmosphere layer 3, which uses air as the heat medium, has a lower temperature than the fluidized bed 2.

It is possible to adjust temperature in the atmosphere layer 3, which uses air as the heat medium, by the set temperature for the fluidized bed 2. Though temperature in the atmosphere layer 3 may be adjusted by setting that in the fluidized bed 2 after taking into consideration the differential temperature between them, more preferably, it is adjusted by the cascade control in which set temperature for the fluidized bed 2 is controlled based on temperature measured by a thermometer also provided in the atmosphere layer 3.

The multi-layered heat treatment furnace of the present invention can suitably treat thermally an aluminum alloy wheel or member around wheel as the work piece, and aging temperature is around 150 to 210° C. for an aluminum alloy work piece.

Next, the heat treatment unit (not shown) which incorporates the aforementioned multi-layered heat treatment furnace will be described.

The heat treatment unit of the present invention is established by using the multi-layered heat treatment furnace as the aging treatment furnace. This heat treatment unit is characterized in that the heat energy of the hot wind used for the solution treatment furnace is reused in the downstream aging treatment furnace, to effectively utilize the heat energy. The heat treatment unit comprises, in addition to the solution furnace and the aging treatment furnace, a hot wind generator, heat-resistant dust collector in the piping system which connects the solution furnace and the aging treatment furnace to each other, and heat-resistant induced and forced draft fans. The hot wind generator has its own fans for supplying air and fuel to be mixed in the hot wind furnace, where the fuel is combusted to produce the hot wind of a high temperature. The hot wind thus produced is passed to the solution treatment furnace for solution treatment, where heat is used, of the work piece, and exhausted therefrom at a slightly lowered temperature, but it is then passed to the heat-resistant dust collector while being kept still at a high temperature. The hot wind where dust was collected (exhaust gas from the solution treatment furnace) is passed to the aging treatment furnace via the induced and forced draft fans, where it is reused as the heat source. The hot wind (exhaust gas from the aging treatment furnace) is released to the atmosphere via the induced draft fan, after being treated to remove dust, as required. It is preferable to provide a heat exchanger between the solution furnace and the aging treatment furnace and upstream of the heat-resistant dust collector, by which the heat of the exhaust gas from the solution treatment furnace is recovered as the heat source for the hot wind to be sent to the aging treatment furnace, viewed from easiness of temperature adjustment, collector capacity and stable operability for extended periods.

The present invention will be described hereinbelow more concretely on the basis of Embodiment.

EXAMPLE

An Al alloy was solution-treated and then aging-treated by the use of a multi-layered heat treatment furnace. The furnace used in the heat treatment was a rectangular tank-shaped, having a 1500 by 1500 mm square cross-sectional area and 750 mm in body height, supported by a trapezoidal container. Sand particles having an average size of 50 to 500 μm were used for the fluidized bed.

The work pieces to be heat-treated were the samples taken from the three positions (outer rim (flange), inner rim (flange) and spoke) of a cast aluminum wheel for a vehicle, 14 kg in weight. The aluminum wheel had a composition of Si: 7.0%, Mg: 0.34% and Al: balance, all by mass.

Figure 5:
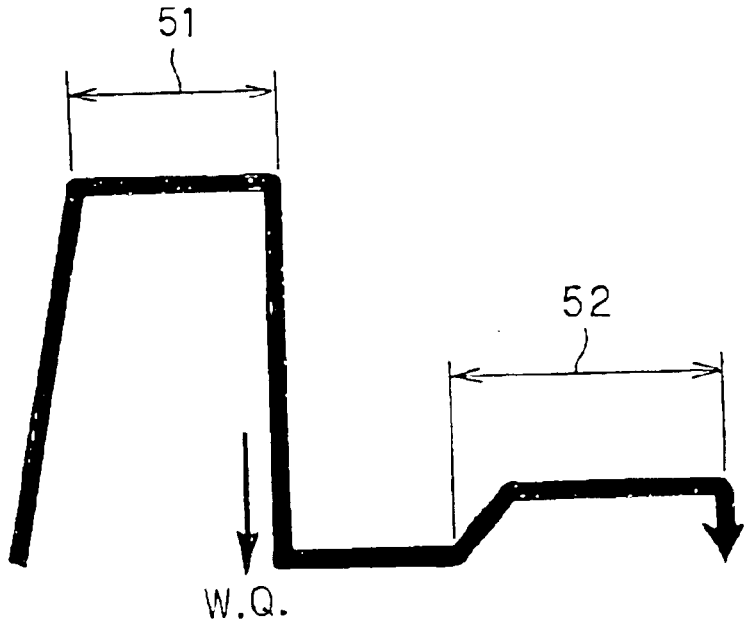
FIG. 5 is a graph illustrating a heat treatment schedule.

The heat treatment conditions were as follows. FIG. 5 shows the heat treatment schedules. The solution treatment was effected continuously under the conditions of 550° C. as the solution treatment temperature and 60 minutes as the solution treatment time 51 with the aluminum wheel totally immersed in the fluidized bed. As shown in FIG. 3, the aging treatment was effected continuously under the conditions of 190° C. as the aging treatment temperature and 60 minutes as the aging treatment time 52 with the outer rim and spoke of the aluminum wheel immersed in the fluidized bed and with the inner rim exposed to the heat medium in the atmosphere layer. The temperature levels of the above solution treatment and the aging treatment were those in the fluidized bed.

Figure 7:
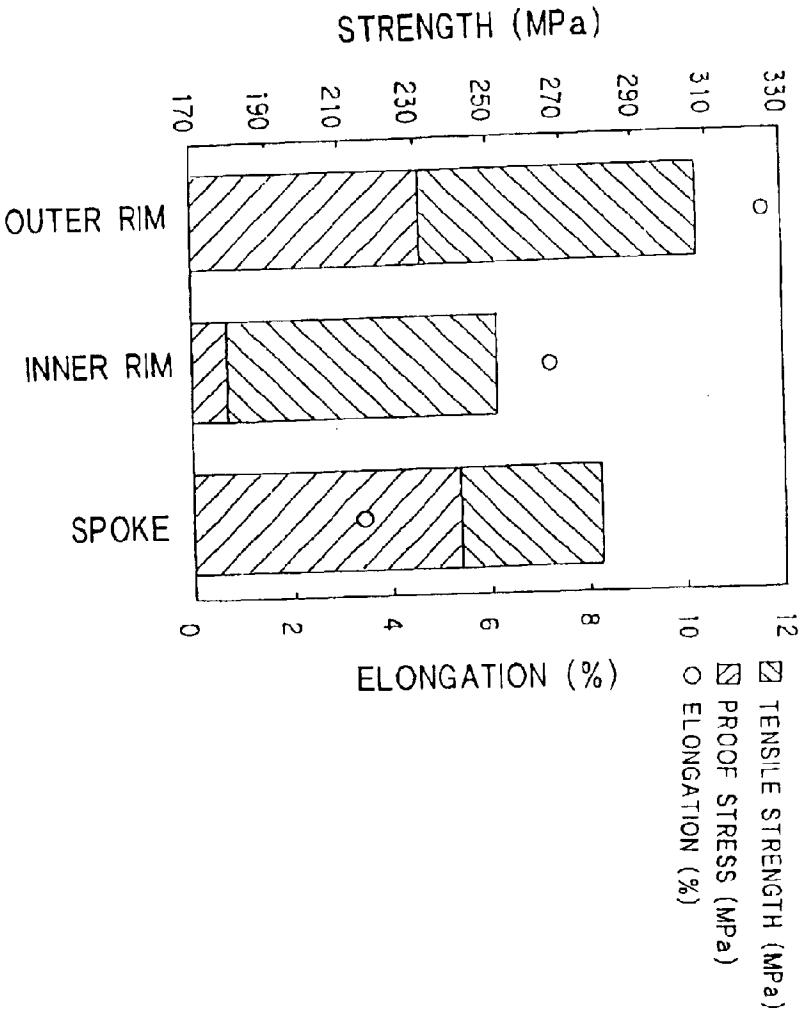
FIG. 7 is a graph illustrating the results of the tensile tests conducted in Example.
Figure 9:
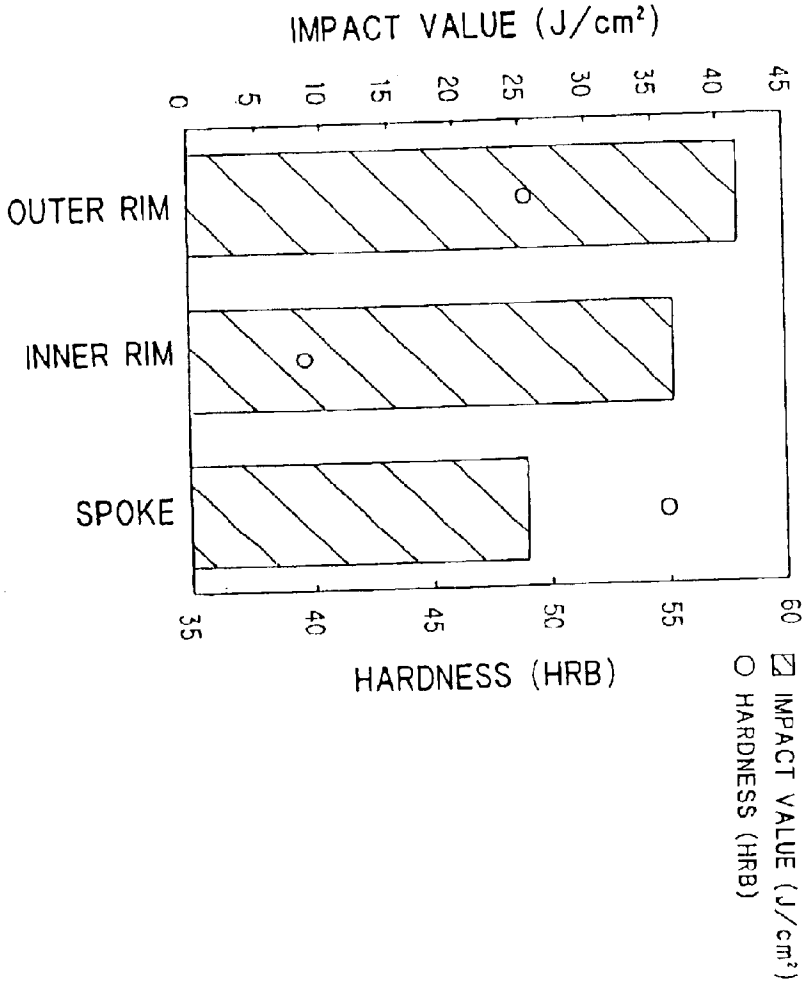
FIG. 9 is a graph illustrating the results of the impact and hardness tests conducted in Example.

The test pieces (n=4) were taken from the heat-treated aluminum wheel, and each was subjected to the tensile test (tensile strength, 0.2% proof strength and elongation), impact test (impact value) and hardness test (hardness). The results are given in FIGS. 7 and 9.

The impact test was conducted in accordance with the Charpy impact test specified by JIS, to determine the impact value. In addition, the hardness test was conducted in accordance with the method specified by JIS Z2245 to determine the Rockwell hardness. The mechanical properties of tensile strength, 0.2% proof strength and elongation were determined by the method specified by JIS Z2201.

Comparative Example

The aluminum wheel was thermally treated in the same manner as in Embodiment, except that it was totally immersed in the fluidized bed for the aging treatment.

Figure 6:
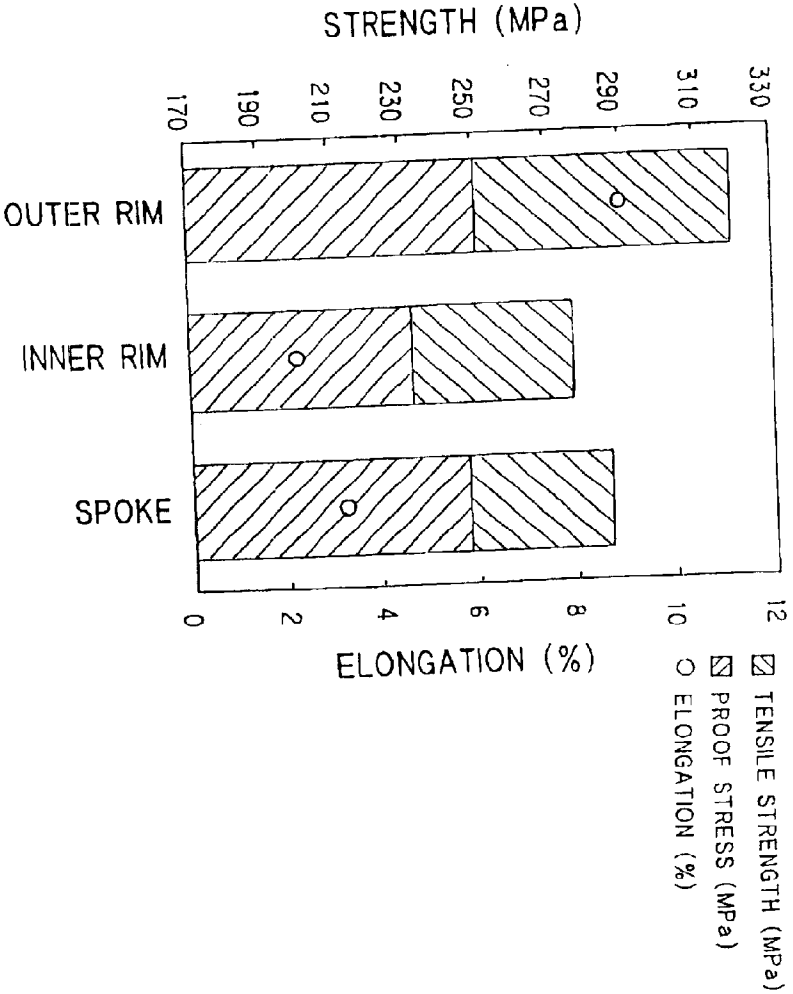
FIG. 6 is a graph illustrating the results of the tensile tests conducted in Comparative Example.
Figure 8:
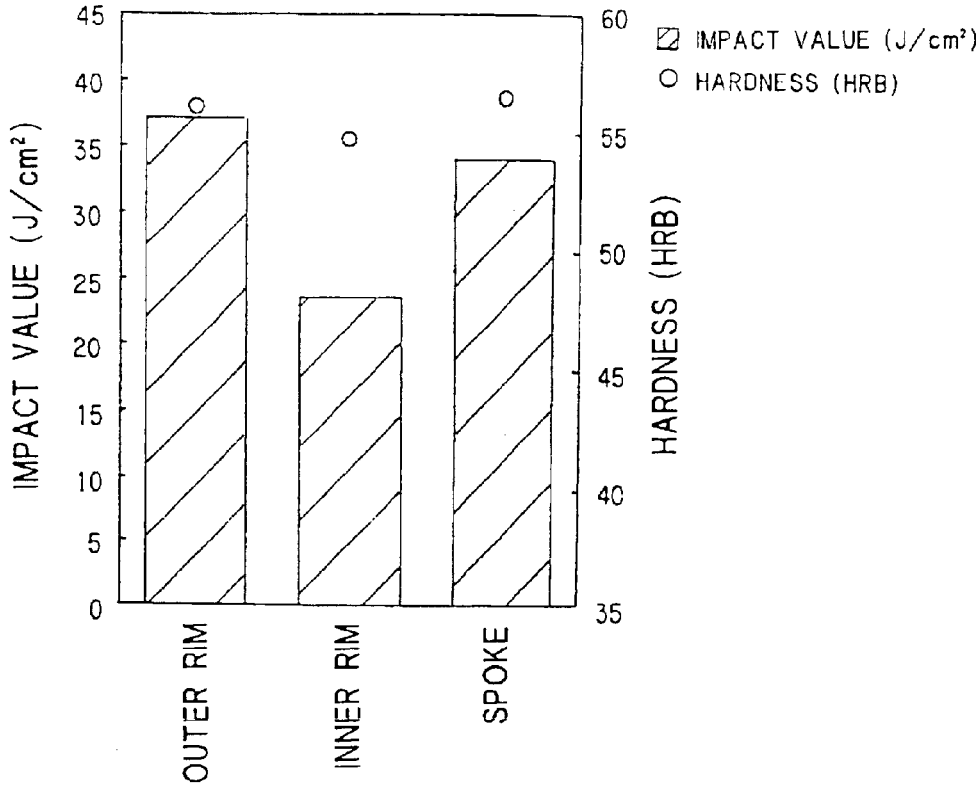
FIG. 8 is a graph illustrating the results of the impact and hardness tests conducted in Comparative Example.

The test pieces (n=4) were taken from the heat-treated aluminum wheel, and each was subjected to the tensile test (tensile strength, 0.2% proof strength and elongation), impact test (impact value) and hardness test (hardness). The results are given in FIGS. 6 and 8.

(Discussion)

The results of the tensile, impact and hardness tests conducted in Example and Comparative Example confirm that the inner rim of the aluminum wheel treated in Embodiment is much more improved in elongation although lower in 0.2% proof strength than that treated in Comparative Example, and that it increases in impact value but decreases in hardness. For the outer rim and spoke, no significant differences are observed in all of the tested properties.

It is obvious from these test results that the multi-layered heat treatment furnace comprising the fluidized bed and the atmosphere layer operating at different temperatures can give the work piece having the desired properties different depending on positions even by the single furnace and once-through heat treatment.

INDUSTRIAL APPLICABILITY

As described above, the present invention provides a heat treatment furnace which can impart desired mechanical properties to each part of a metallic product, a heat treatment unit which incorporates the heat treatment furnace, and a method of heat treatment which uses the heat treatment unit. The metallic product having the desired properties can be made thinner to reduce the production cost. In particular, in a product of aluminum alloy, which is a material for reducing weight, further lightening can be planed by thinning the product with suppressing the cost, thereby the present invention contributes also to its increased demands.

What is claimed is:

1. A multi-layered heat treatment furnace for heat treatment of a metallic work piece comprising:

a container comprising a bottom portion;

means for supplying forced hot gas to said bottom portion;

located at the bottom portion, and comprising particles for being fluidized by forced hot gas supplied from the bottom portion of the container by the means for supplying forced hot gas; and said container also comprising an atmosphere layer portion located over the fluidized bed, said atmosphere layer comprising air as a heat medium for heating a portion of a work piece, wherein at least the bottom portion of the container comprises a thermally insulating material.

2. The multi-layered heat treatment furnace according to claim 1, further comprising means for transferring a work piece for varying a ratio of a first part of such work piece immersed in the fluidized bed to second part of such work piece exposed to the heat medium in the atmosphere layer in a range from 0:100% to 100:0%.

3. The multi-layered heat treatment furnace according to claim 1, further comprising means for holding each of two or more work pieces for simultaneously heat-treating some work pieces differently than other work pieces.

4. The multi-layered heat treatment furnace according to claim 1, wherein the means for supplying forced hot gas comprises a header tube and a dispersion tube, wherein at least the dispersion tube is located in said fluidized bed.

5. The multi-layered heat treatment furnace according to claim 1, further comprising means for reducing temperature of said atmosphere layer portion.

6. The multi-layered heat treatment furnace according to claim 1, further comprising means for automatically controlling an interface between said fluidized bed and said atmosphere layer portion.

7. The multi-layered heat treatment furnace according to claim 1, further comprising means for automatically controlling temperature in said fluidized bed.

8. The multi-layered heat treatment furnace according to claim 1, wherein said fluidized bed is configured for holding a work piece comprising an aluminum alloy automobile wheel and for applying separate heat treatments to each of a plurality of portions of such wheel.

9. A heat treatment unit comprising the multi-layered heat treatment furnace according to claim 1 as an aging treatment furnace, a solution treatment furnace, a heat-resistant dust collector a heat exchanger, and means for conveying an exhaust gas from said solution treatment furnace through the dust collector to remove dust and then through the heat exchanger to recover waste heat from the exhaust gas, the recovered heat for reuse as a heat source for said aging treatment furnace.

10. A method of heat treatment of a metallic work piece, first by solution treatment and then by aging treatment, the method comprising:

providing a multi-layered heat treatment furnace comprising a container comprising a fluidized bed with particles for being fluidized and an atmosphere layer portion located over the fluidized bed; blowing hot gas into the container to fluidize the particles;

age treating a workpiece located at least partly in the atmosphere layer portion over the fluidized bed with air as the heat medium, wherein a first portion of such work piece is exposed to the heat medium in the atmosphere layer portion for heat-treatment at a temperature different than a temperature of a second portion of such work piece immersed in the fluidized bed.

11. The method of heat treatment according to claim 10, comprising age treating a work piece with said multi-layered heat treatment furnace, wherein a temperature in said fluidized bed is set at an aging temperature.

12. The method of heat treatment according to claim 11, wherein said work piece is made of an aluminum alloy and said aging temperature is a range from 150° C. to 210° C.

13. The method of heat treatment according to claim 10, age treating a work piece with said multi-layered heat treatment furnace; and controlling a first temperature in said fluidized bed to set a second temperature in said atmosphere layer portion at an aging temperature.

* * * * *